US012351373B2

(12) United States Patent
Forrest

(10) Patent No.: US 12,351,373 B2
(45) Date of Patent: Jul. 8, 2025

(54) RELEASABLE CONTAINER CAP

(71) Applicant: Paul Bradley Forrest, Cary, NC (US)

(72) Inventor: Paul Bradley Forrest, Cary, NC (US)

( * ) Notice: Subject to any disclaimer, the term of this patent is extended or adjusted under 35 U.S.C. 154(b) by 0 days.

(21) Appl. No.: 18/506,498

(22) Filed: Nov. 10, 2023

(65) Prior Publication Data

US 2024/0076109 A1 Mar. 7, 2024

Related U.S. Application Data

(63) Continuation of application No. PCT/US2022/029032, filed on May 12, 2022, which is a continuation-in-part of application No. 17/318,712, filed on May 12, 2021, now Pat. No. 11,542,067.

(51) Int. Cl.
*B65D 55/16* (2006.01)
*B65D 41/34* (2006.01)

(52) U.S. Cl.
CPC ..... *B65D 55/16* (2013.01); *B65D 41/3409* (2013.01); *B65D 2401/30* (2020.05)

(58) Field of Classification Search
CPC .... B65D 41/3428; B65D 1/0246; B29C 49/52
USPC ..... 215/901, 252, 329, 216
See application file for complete search history.

(56) References Cited

U.S. PATENT DOCUMENTS 2,169,686 A * 8/1939 Fabrice ..... B65D 41/348 215/901
3,703,975 A * 11/1972 Wittemer ..... G11C 11/40 220/212.5
3,993,208 A * 11/1976 Ostrowsky ..... B65D 50/046 215/320
4,103,798 A * 8/1978 Moeller ..... B65D 41/02 215/200
4,166,552 A * 9/1979 Faulstich ..... B65D 41/485 215/901
4,320,843 A * 3/1982 Dubach ..... B65D 41/485 215/256
4,436,211 A * 3/1984 Gach ..... B65D 50/046 215/216
4,452,363 A * 6/1984 Davis ..... B65D 41/3452 215/258
4,480,762 A * 11/1984 Thomas ..... B65D 50/045 215/280
4,572,389 A * 2/1986 Gach ..... B65D 41/34 215/253
4,709,823 A * 12/1987 Beck ..... B65D 55/0863 215/254

(Continued)

OTHER PUBLICATIONS

ISA/US; International Search Report and Written Opinion for International Patent Application No. PCT/US2022/029032 mailed Aug. 16, 2022, 7 pages.

(Continued)

*Primary Examiner* — Steven A. Reynolds
*Assistant Examiner* — Prince Pal
(74) *Attorney, Agent, or Firm* — NK Patent Law

(57) ABSTRACT

A container has an improved releasable cap that is releasable with upward movement of the cap. A coupler also couples the cap to the container and provides for a stowed position in which the cap does not interfere with use of the container, and maintains the cap in a connected to configuration with the container at all times.

15 Claims, 13 Drawing Sheets

(56) References Cited

U.S. PATENT DOCUMENTS 4,752,013 A * 6/1988 Miller ..... B65D 41/3409 215/253
4,752,014 A * 6/1988 House ..... B65D 50/046 215/216
4,981,230 A * 1/1991 Marshall ..... B65D 41/3428 D9/453
5,431,305 A * 7/1995 Kaminski ..... B65D 47/244 222/521
5,603,421 A * 2/1997 Opresco ..... B65D 50/046 215/217
5,642,825 A * 7/1997 Wohlgemuth ..... B65D 41/47 215/901
5,649,637 A * 7/1997 Weiler ..... B65D 1/0246 604/905
5,660,289 A * 8/1997 Spatz ..... B26D 7/01 215/252
5,687,863 A * 11/1997 Kusz ..... B65D 50/046 215/331
5,775,528 A * 7/1998 Wohlgemuth ..... B65D 55/022 215/901
5,836,466 A * 11/1998 Briere ..... B65D 50/046 215/217
5,908,125 A * 6/1999 Opresco ..... B65D 50/046 215/217
5,915,576 A * 6/1999 Robinson ..... B65D 50/046 215/334
5,927,527 A * 7/1999 Montgomery ..... B65D 50/046 D9/453
5,941,404 A * 8/1999 Charrette ..... B65D 41/04 D9/520
6,036,036 A * 3/2000 Bilani ..... B65D 50/046 215/219
6,089,390 A * 7/2000 Druitt ..... B65D 41/3447 215/307
6,102,223 A * 8/2000 Montgomery ..... B65D 50/046 215/44
6,112,921 A * 9/2000 Robinson ..... B65D 50/046 215/221
6,253,942 B1 * 7/2001 Elias ..... B65D 41/0485 D9/451
6,260,721 B1 * 7/2001 Ohmi ..... B65D 41/485 215/901
6,332,550 B1 * 12/2001 Bennett ..... B65D 41/62 220/255
6,394,294 B1 * 5/2002 Briere ..... B65D 41/3447 215/901
6,439,409 B1 * 8/2002 Dressel ..... B65D 50/046 215/209
6,726,042 B2 * 4/2004 Schweigert ..... B65D 41/3447 215/901
6,736,280 B1 * 5/2004 Zapata ..... B65D 41/3428 215/256
D491,063 S * 6/2004 Hicks ..... D9/453
6,811,047 B1 * 11/2004 Hicks ..... B65D 41/0421 215/305
6,886,708 B2 * 5/2005 Kaufman ..... B65D 83/40 220/257.1
7,513,377 B1 * 4/2009 Culley ..... B65D 41/3428 215/901
D621,706 S * 8/2010 Breckan ..... D9/443
D630,043 S * 1/2011 Taggart ..... D9/443
D636,264 S * 4/2011 Wassum ..... D9/453
7,946,443 B2 * 5/2011 Stull ..... B65D 47/0847 220/784
8,051,999 B2 * 11/2011 Carmody ..... B65D 50/046 215/219
8,245,880 B1 * 8/2012 Bragg ..... B65D 47/242 215/221
8,302,794 B2 * 11/2012 Russell ..... B65D 41/3423 215/258
8,763,830 B2 * 7/2014 Sadiq ..... B65D 41/3428 215/901
9,102,449 B2 * 8/2015 Gatton ..... B65D 83/06
9,771,190 B2 * 9/2017 Piscopo ..... B65D 50/046
9,889,977 B2 * 2/2018 Piscopo ..... B65D 50/046
9,987,634 B2 * 6/2018 Piramoon ..... B01L 3/508
10,011,406 B2 * 7/2018 Daley ..... B65D 41/0407
10,112,742 B1 * 10/2018 Circosta ..... B65D 41/0414
10,196,178 B2 * 2/2019 Martini ..... B65D 41/0485
10,414,551 B2 * 9/2019 Martini ..... B65D 41/3428
D874,931 S * 2/2020 Friedman ..... D9/443
10,556,403 B2 * 2/2020 Cavanna ..... B29C 66/83221
10,625,901 B2 * 4/2020 Martini ..... B29C 65/3656
10,954,042 B2 * 3/2021 French ..... B65D 50/00
2001/0027957 A1 * 10/2001 Kano ..... B65D 41/3428 215/354
2002/0066713 A1 * 6/2002 Ma ..... B65D 41/3428 215/252
2002/0084239 A1 * 7/2002 Dressel ..... B65D 50/046 215/209
2003/0173325 A1 * 9/2003 Mavin ..... B65D 51/1661 215/354
2003/0201283 A1 * 10/2003 Branson ..... B65D 50/04 222/153.14
2004/0016715 A1 * 1/2004 Strikovic ..... B65D 55/16 215/306
2004/0074861 A1 * 4/2004 Chuang ..... B65D 41/3428 215/252
2004/0074919 A1 * 4/2004 Knickerbocker .... B65D 50/046 222/1
2004/0262251 A1 * 12/2004 Tauber ..... B65D 50/041 215/220
2005/0017029 A1 * 1/2005 Laverdure ..... B65D 33/1658 222/490
2005/0023238 A1 2/2005 Wong
2005/0133475 A1 * 6/2005 Goto ..... B65D 50/046 215/237
2006/0057257 A1 * 3/2006 Ma ..... B65D 41/3447 426/115
2006/0213860 A1 * 9/2006 Robinson ..... B65D 50/046 215/331
2007/0034590 A1 * 2/2007 Hidding ..... B65D 1/0246 215/252
2008/0067142 A1 * 3/2008 Druitt ..... B65D 41/04 215/324
2008/0124432 A1 * 5/2008 Ma ..... B65D 41/3447 222/521
2008/0142468 A1 * 6/2008 Delagrange ..... B65D 47/0804 215/209
2008/0149586 A1 * 6/2008 Loughrin ..... B65D 41/3428 215/252
2008/0245796 A1 * 10/2008 Gnepper ..... B65D 47/265 220/281
2009/0045158 A1 * 2/2009 Suriol ..... B65D 41/0435 215/256
2009/0178995 A1 * 7/2009 Tung ..... B65D 1/0246 215/316
2010/0025355 A1 * 2/2010 Beecroft ..... B65D 50/046 215/216
2010/0059518 A1 * 3/2010 Brozell ..... B65D 41/0471 220/323
2010/0320168 A1 * 12/2010 Bull ..... B65D 50/046 215/219
2011/0024420 A1 * 2/2011 King ..... B65D 51/18 220/254.8
2011/0024423 A1 * 2/2011 Erspamer ..... B65D 41/3428 220/266
2011/0094990 A1 * 4/2011 Sprishen ..... B65D 50/041 215/217
2011/0114593 A1 * 5/2011 Ishii ..... B65D 41/325 215/253
2011/0290756 A1 * 12/2011 Horstman ..... B65D 41/26 215/329
2012/0091134 A1 * 4/2012 Sadiq ..... B65D 41/325 220/214
2012/0175336 A1 * 7/2012 Miller ..... B65D 3/04 215/216

(56) References Cited

U.S. PATENT DOCUMENTS

2013/0097973 A1* 4/2013 McCoy ..... B65D 25/205 215/200
2013/0098864 A1* 4/2013 Fontana ..... B65D 1/095 215/250
2014/0021157 A1* 1/2014 Gren ..... B65D 41/0421 215/252
2014/0103043 A1* 4/2014 Lonsway ..... B65D 41/02 220/255
2014/0138380 A1* 5/2014 Fox ..... B65D 41/565 220/214
2014/0332494 A1* 11/2014 Balakier ..... B65D 1/0246 215/365
2015/0014269 A1* 1/2015 Gillman ..... B65D 50/041 215/217
2016/0016703 A1* 1/2016 Mühlemann ..... B65D 41/06 222/566
2016/0145016 A1* 5/2016 Miceli ..... B65D 50/046 215/215
2016/0176586 A1* 6/2016 Mélan-Moutet ..... B65D 41/325 215/252
2016/0176590 A1* 6/2016 Prater ..... B65D 85/70 215/44
2016/0347512 A1* 12/2016 Horner ..... B65D 41/04
2017/0021978 A1* 1/2017 Keener ..... B65D 41/0414
2017/0174398 A1* 6/2017 Cox ..... B65D 47/0804
2017/0197766 A1* 7/2017 Carraro ..... B65D 1/0246
2017/0203889 A1* 7/2017 Butter-Jentsch ..... B65D 50/04
2017/0259966 A1* 9/2017 Cerveny ..... B65D 43/0256
2017/0273435 A1* 9/2017 Megaro ..... B05B 11/0037
2017/0349341 A1* 12/2017 Girardot ..... B65D 50/043
2018/0099796 A1* 4/2018 Migas ..... B65D 51/145
2018/0118427 A1* 5/2018 Lee ..... B65D 45/322
2018/0215506 A1* 8/2018 Burns ..... B65D 23/108
2018/0215512 A1* 8/2018 Toh ..... B65D 1/0246
2018/0312297 A1* 11/2018 Knobel ..... B65D 21/0213
2018/0327146 A1* 11/2018 Martini ..... B65D 41/0485
2019/0210777 A1* 7/2019 McNabb ..... B65D 50/046
2019/0276201 A1* 9/2019 French ..... B65D 50/043
2019/0375556 A1* 12/2019 Hanan ..... B65D 41/3414
2020/0017260 A1* 1/2020 Migas ..... B65D 55/16
2020/0031540 A1* 1/2020 Dzurik ..... B65D 47/0838
2020/0198855 A1* 6/2020 Sterling ..... B65D 50/043
2020/0246221 A1* 8/2020 Gloria Bello ..... B65D 1/023
2020/0339312 A1* 10/2020 Krautkrämer ..... B67D 3/0032
2020/0339320 A1* 10/2020 Biesecker, II ..... B65D 51/245
2020/0346813 A1* 11/2020 Campbell ..... B65D 1/0246
2020/0369446 A1* 11/2020 Mélan-Moutet ... B65D 41/3447
2020/0377264 A1* 12/2020 Kutsuna ..... B65D 1/0246
2020/0399036 A1* 12/2020 Dai ..... B65D 41/325
2020/0407124 A1* 12/2020 Caszatt ..... B65D 47/0838
2021/0031983 A1* 2/2021 Azelton ..... B65D 1/0246
2021/0031986 A1* 2/2021 Gerber ..... B65D 41/3428
2021/0094733 A1* 4/2021 Bloom ..... B65D 41/3442
2021/0130052 A1* 5/2021 Berge ..... B65D 51/18
2021/0155381 A1* 5/2021 Dabbur ..... B65D 41/3428
2021/0188499 A1* 6/2021 Ekkert ..... B65D 50/061
2021/0309420 A1* 10/2021 Druitt ..... B65D 41/325
2021/0371173 A1* 12/2021 Sterling ..... B65D 55/024
2022/0041350 A1* 2/2022 Berge ..... B65D 50/041
2022/0048681 A1* 2/2022 Grabarczyk ..... B65D 41/485
2022/0153480 A1* 5/2022 Mayer ..... B65D 41/3428
2022/0185554 A1* 6/2022 Falzoni ..... B65D 41/3447
2022/0194673 A1* 6/2022 Erwin ..... B65D 55/16
2022/0204228 A1* 6/2022 Bassi ..... B26D 1/0006
2022/0289441 A1* 9/2022 Zangerle ..... B65D 41/3428
2022/0363446 A1* 11/2022 Forrest ..... B65D 41/3409
2023/0025075 A1* 1/2023 Leuenberger ..... B65D 41/3447
2023/0042976 A1* 2/2023 Kainz ..... B65D 55/16
2023/0056087 A1* 2/2023 Graux ..... B65D 41/3428
2024/0076109 A1* 3/2024 Forrest ..... B65D 55/16

OTHER PUBLICATIONS

WIPO, International Preliminary Report on Patentability for International Patent Application No. PCT/US2022/029032 dated Nov. 14, 2023, 6 pages.
USPTO, Non-Final Office Action for corresponding U.S. Appl. No. 17/318,712, dated Apr. 25, 2022, 18 pages.
USPTO, Final Office Action for corresponding U.S. Appl. No. 17/318,712, dated May 27, 2022, 23 pages.
USPTO, Non-Final Office Action for corresponding U.S. Appl. No. 17/318,712, dated Aug. 16, 2022, 12 pages.

* cited by examiner

RELEASABLE CONTAINER CAP

CROSS-REFERENCE TO RELATED APPLICATIONS

This application is a continuation of PCT Patent Application No. PCT/US2022/029032 filed on May 12, 2022, which claims priority to U.S. Nonprovisional patent application Ser. No. 17/318,712 filed on May 12, 2021, now U.S. Pat. No. 11,542,067 issued on Jan. 3, 2023, the entire contents of all of which are incorporated by reference herein.

TECHNICAL FIELD

The present disclosure relates to caps for containers for fluids such as beverages and others. More particularly, the present disclosure relates to a releasable container cap having releasable threads or other inward protruding male engagement features such as a rib or ring. The container cap may be operatively coupled at all times with the container with a tether or similar coupling structure such that the cap cannot be lost or removed from the bottle.

BACKGROUND

Conventional containers such as beverage bottles have threaded caps that are removed by rotation. Removal of the cap can take several turns before the threads of the cap are disengaged from the threaded neck of the container, and for some, both hands are required for the operation. In some uses, for example when driving or otherwise occupied, conventional caps are challenging or inconvenient.

Additionally, caps are oftentimes misplaced from the bottle. This causes a loss of functionality of the bottle, and also reduces recycling compliance. However, caps are not easily tethered to a bottle without the tethers becoming an interference, and tethers even more cumbersome for use with bottles having a cap that is removed by twisting movement of the cap.

Additionally, threaded caps that are tethered to the bottle often place the opened cap in a position that makes the bottle awkward or impractical to drink from or pour.

An improved container cap is needed.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

An improved releasable container cap according to at least one embodiment includes: a circular top piece for sealing a container; two sidewall sections connected to the top piece, each sidewall section having an internal threaded portion for engaging threads of the container, each sidewall section having two circumferential ends. Each circumferential end of each sidewall section is spaced from an adjacent circumferential end of the other sidewall section such that two diametrically opposed expandable gaps are formed as hollow protrusions defined between the spaced circumferential ends; and two tabs each spanning a respective one of the two gaps, the tabs bulging outward from the sidewall sections, wherein the tabs are configured to be pressed inward thereby causing the sidewall sections to flex outward to disengage the threads of the container permitting the cap to be removed therefrom. The hollow protruding tabs provide open space to allow compression without interrupting the continuous perimeter of the cap and hollow protrusions combined.

A container has an improved releasable cap according to at least one embodiment, the container including a neck having external threads. The cap includes: a circular top piece for sealing the container; two sidewall sections connected to the top piece, each sidewall section having an internal threaded portion for engaging the external threads of the neck of the container, each sidewall section having two circumferential ends, wherein each circumferential end of each sidewall section is spaced from an adjacent circumferential end of the other sidewall section such that two diametrically opposed expandable gaps are defined between the spaced circumferential ends; and two tabs each spanning a respective one of the two gaps, the tabs bulging outward from the sidewall sections, wherein the tabs are configured to be pressed inward thereby causing the sidewall sections to flex outward to disengage the internal threaded portions thereof from the external threads of the neck of the container permitting the cap to be removed therefrom.

Each tab may include two ends each connected to a respective sidewall section adjacent a circumferential end of the sidewall section, and a central part between the two ends, the central part spanning the respective gap.

The gaps may expand when the sidewall sections flex outward.

The tabs may be tapered, reducing radially toward the top piece.

The tabs may be configured to be pressed inward along a first diametric axis causing the sidewall sections to flex outward in opposite directions along a second diametric axis perpendicular to the first diametric axis.

The cap may be configured to be removed from the container by rotation without the tabs being pressed.

The internal threaded portion of each sidewall section may have threads having at least one tapered circumferential end.

A tamper-proof ring may be attached to the sidewall sections by frangible strips.

A container assembly is provided that includes a bottle for including contents. The bottle includes a bottle neck extending from the bottle, where the bottle neck including a first circumferentially extending outwardly threaded portion, and a discontinuous second circumferentially extending outwardly threaded portion. Medial portions between the first circumferentially extending outwardly threaded portion and the second circumferentially extending outwardly threaded portion are free of threads. The bottle further defines a radially extending shoulder that extends from the bottle neck. A cap is configured for being rotatably received on and engaged with the bottle neck, the cap defining a first circumferentially extending inwardly threaded portion, and a discontinuous second circumferentially extending inwardly threaded portion. Medial portions between the first circumferentially extending inwardly threaded portion and the second circumferentially inwardly extending threaded portion are free of threads. The cap is configured to engage and disengage the bottle neck, where engagement occurs in a first engagement mode where an interference fit occurs between the outwardly extending threads of the bottle neck and the inwardly extending threads of the cap, and where engagement occurs in a second engagement mode that is in response to general angular alignment of the medial portions of the bottle neck and the medial portions of the cap such that the threaded portions of the bottle neck and the threaded portions of the cap do not restrict upward movement of the cap in response to a user lifting the cap off of the bottle. A tamper proof retaining ring is received by the bottle neck. The tamper proof retaining ring is configured for rotational movement about the bottle neck and engaging a distal surface of the cap. The retaining ring is positioned above the radially extending shoulder of the bottle neck. A coupler extends between the retaining ring and the cap. The coupler allows for inversing movement of the cap from an engaged position to a stowed position in which the cap is hingedly pivoted away from the bottle neck and the distal surface of the cap is engaged with a bottom surface of the radially extending shoulder.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
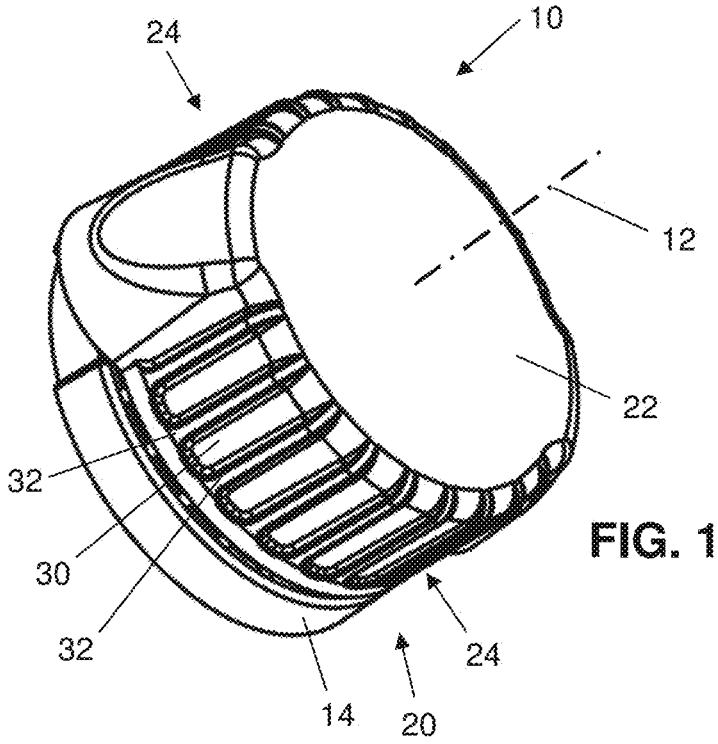
FIG. 1 is a perspective view of an improved releasable container cap, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Figure 2:
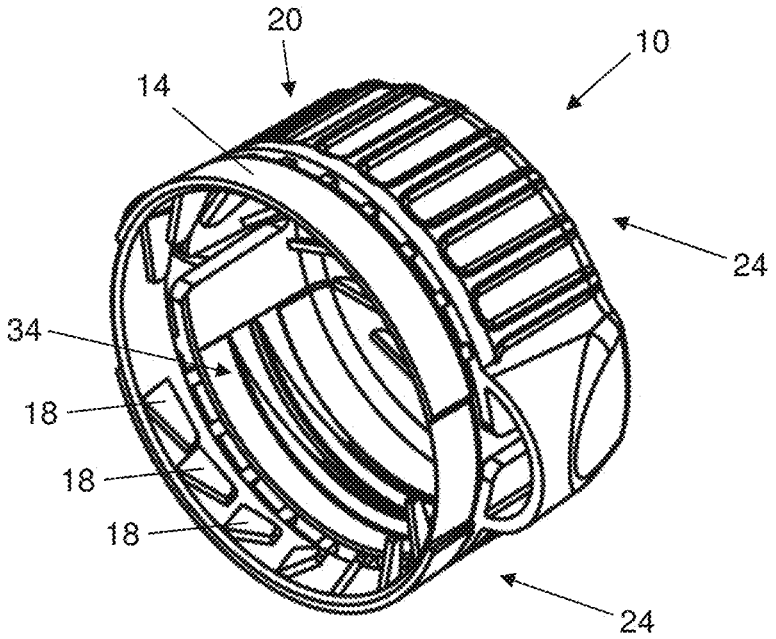
FIG. 2 is another perspective view of the cap of FIG. 1.
Figure 3:
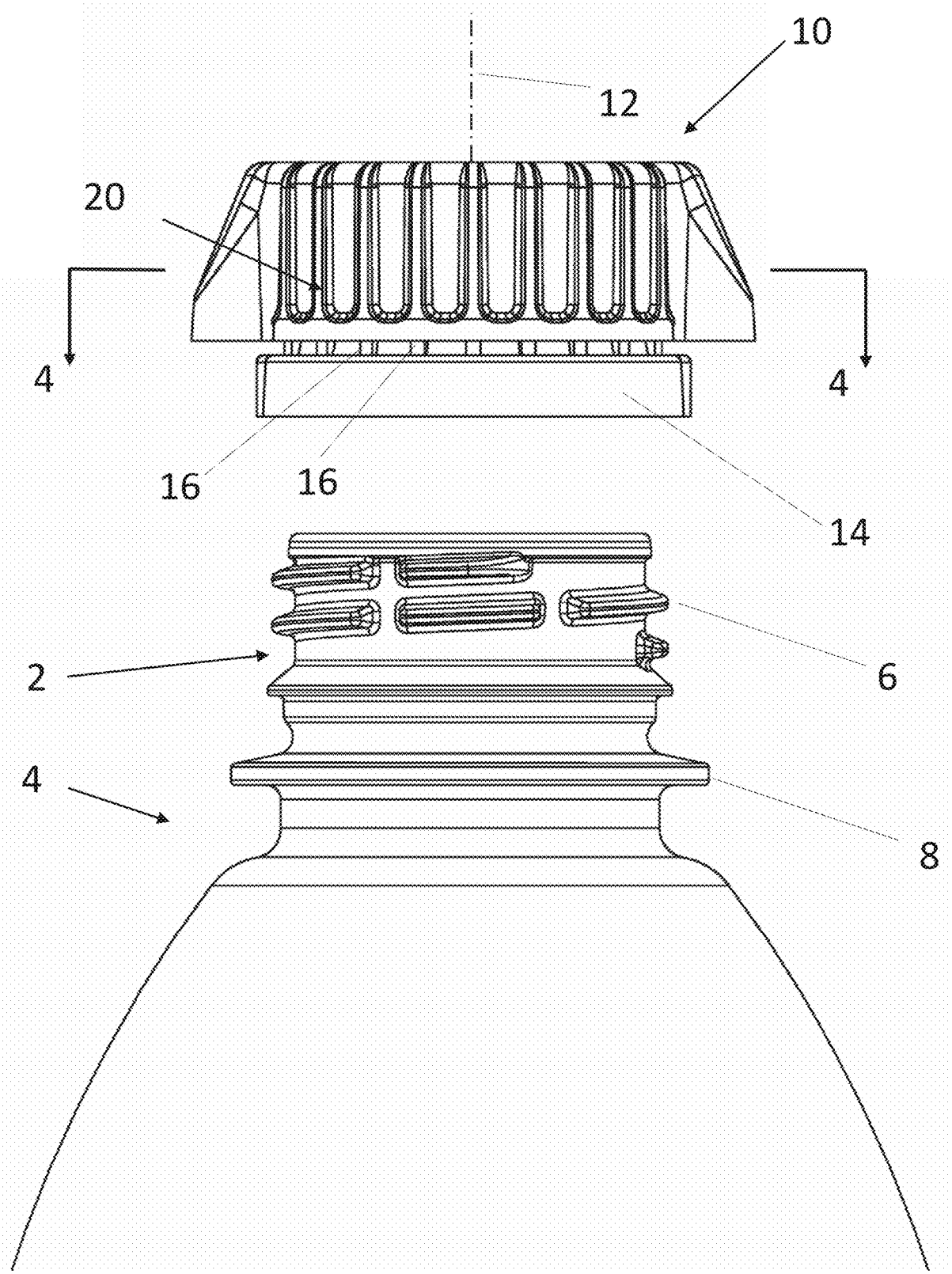
FIG. 3 is a side view of the cap of FIG. 1 aligned with the neck of an exemplary container.

An improved releasable container cap 10 having releasable threads, according to at least one embodiment, is shown in FIGS. 1-8. From a use perspective, the container cap 10 can be used conventionally in that, once mounted on the threaded neck 2 of a container 4, a non-limiting example of which is shown in FIG. 3 for illustration of use of the container cap 10. The container 4 is partially illustrated, showing particularly its top end, representing that the container can have any volume and overall size. The cap 10 can be removed by user action rotating the cap 10 around its longitudinal axis 12. The rotation causes the cap 10 to advance along the neck 2 of a container, as internal helical threads of the cap 10 engaging corresponding external threads 6 of the container neck 2 advance the cap 10, until the cap 10 is removed. A tamper-proof security ring 14 attached to the sidewall sections of the main body 20 of the cap 10 by frangible strips 16 is removed from the main body by breaking of the strips as the cap 10 is removed from the container. Flaps 18 (FIG. 1) along the interior of the tamper-proof ring 14 keep the ring centered beyond a fixed ring 8 (FIG. 3) on the neck 2 to keep the ring 14 on the container 4 as the cap 10 is removed.

Once removed or loosened by rotation, the cap 10 can be tightened to reseal a container by opposite rotation and threaded re-engagement. The cap 10 can be repeatedly used in this fashion.

The container cap 10 also has novel features advantageously improved over prior container caps 10 that are also used conventionally as just described. In particular, the cap 10 has releasable internal threads that are disengaged from the threaded neck of a container when unique tabs are pressed by user action, permitting the cap 10 to be removed without necessitating its rotation.

Figure 7:
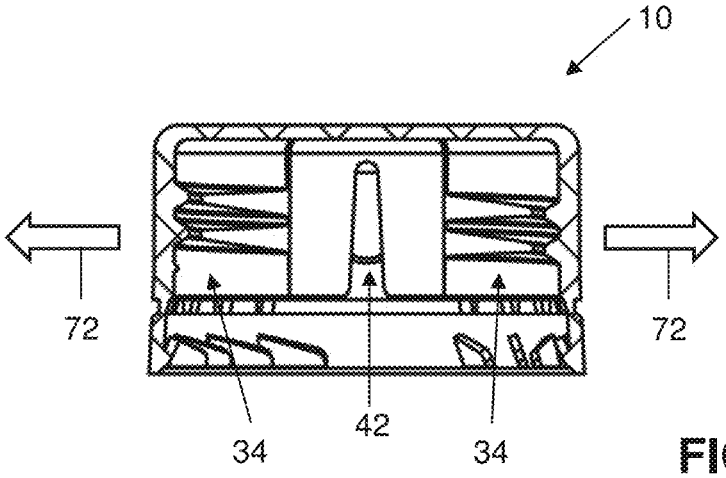
FIG. 7 is a cross-sectional side view of the cap of FIG. 1 as taken along the line 7-7 in FIG. 6.
Figure 8:
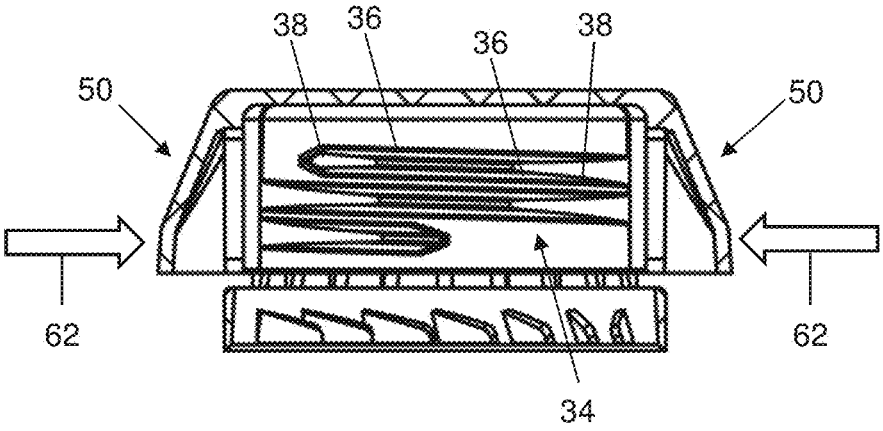
FIG. 8 is a cross-sectional side view of the cap of FIG. 1 as taken along the line 8-8 in FIG. 6.

Describing now in detail the structural features of the container cap 10, the main body 20 has a generally circular top piece 22 defining a longitudinal end of the cap 10. Two sidewall sections 24 are connected to and integral with the top piece 22 along its circular perimeter and extend longitudinally therefrom to define an interior 26 (FIG. 6) of the cap 10 for receiving and engaging the threaded neck of a container in use. The exterior surfaces 30 of the sidewall sections 24 configured to be gripped, having longitudinally extending grip ridges 32 in the illustrated embodiment. The interior surfaces of the sidewall sections 24 each have a respective threaded portion 34 (FIG. 2, FIG. 7). The two threaded portions 34 of the two sidewall sections 24 cooperate to engage the threaded neck of a container in use as the top piece 22 seals the container. The threads 36 (FIGS. 7-8) of the threaded portions 34 can have an industry standard pitch or customized pitch to match a preferred use and container 4 such as that shown in FIG. 3.

Each sidewall section 24 is formed as a partial semicircle and thus wraps circumferentially around the longitudinal axis 12 by less than one hundred and eighty degrees. Thus, the circumferential ends 40 (FIG. 4) of the two sidewall sections 24 do not meet. Instead, each circumferential end 40 of each sidewall section 24 is spaced from an adjacent circumferential end 40 of the other sidewall section such that two diametrically opposed expandable gaps 42 are defined between the spaced circumferential ends 40. The gaps 42 are minimized in an engagement configuration of the cap 10, which is illustrated in the drawings, referring to the cap 10 in use or ready for use in engaging the threaded neck of a container and sealing the container.

A respective operable tab 50 spans each gap along the exterior of the cap 10. Each tab has two ends 52 (FIG. 4), each connected to a respective sidewall section 24 adjacent the circumferential end 40 of the sidewall section. A central part 54 of each tab 50, between the two ends 52 thereof, bulges radially outward over and spans a respective gap 42. The tabs 50 may be tapered as illustrated, reducing radially toward the top piece 22 of the cap 10 to provide a comfortable overall form and minimize the likelihood of snagging on other items when handled. Thus, as described and shown in the drawings, the tabs can be described as hollow protrusions in that each has an open interior space to allow its compression without interrupting the continuous perimeter of the cap and tabs combined.

Figure 4:
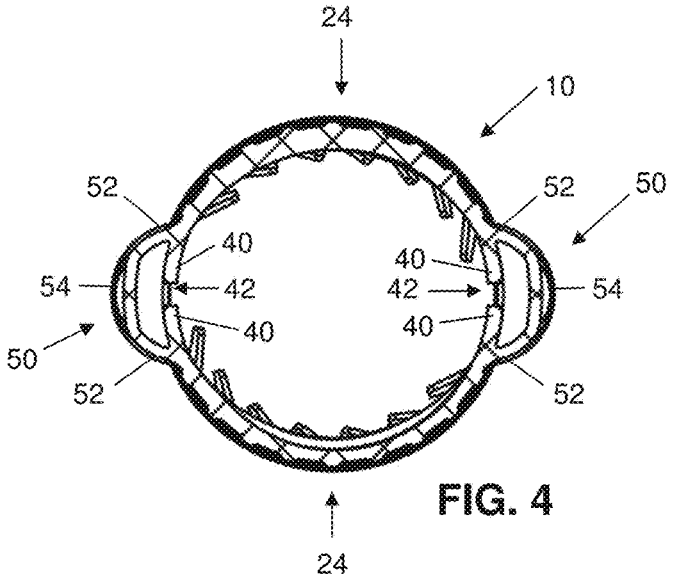
FIG. 4 is a cross-sectional longitudinal view of the cap of FIG. 1 as taken along the line 4-4 in FIG. 3.
Figure 5:
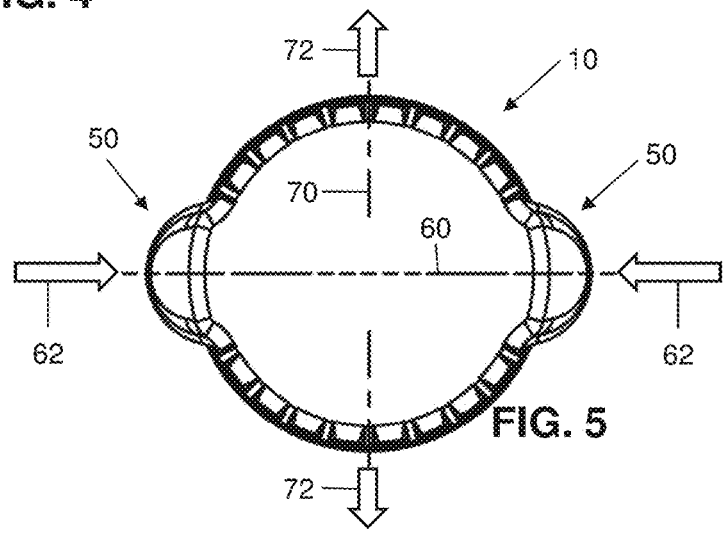
FIG. 5 is top view of the cap of FIG. 1.
Figure 6:
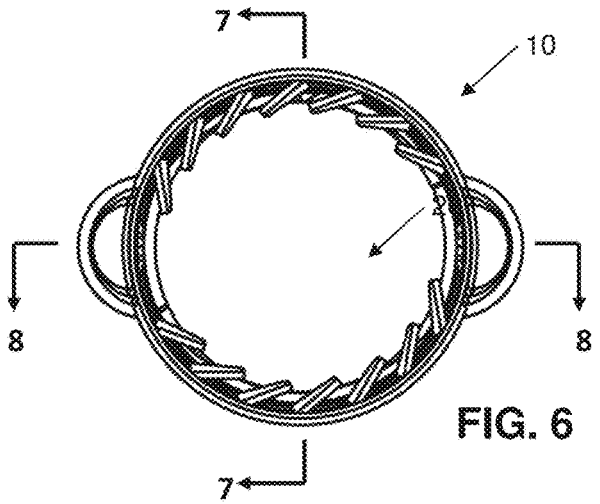
FIG. 6 is a bottom view of the cap of FIG. 1.

The tabs 50 are diametrically opposed. A first diametric axis 60 between the two tabs 50 crosses the longitudinal axis 12 that defines the center of the cap 10. The tabs 50 are operated by user action, for example with an index finger and thumb, pressing them radially inward at the central parts 54 as represented by opposing pinching forces 62 in FIG. 5. This causes: the central parts 54 of the tabs 50 to move inward; the gaps 42 to be expanded; and the sidewall sections 24 to be flexed in radially outward opposite directions 72 along a second diametric axis 70 as represented in FIG. 4. In the illustrated embodiment of the cap 10, the first diametric axis 60, the second diametric axis 70, and the longitudinal axis 12 are mutually orthogonal.

As the sidewall sections 24 are flexed radially outward by user action pinching the central parts 54 of the operable tabs 50 radially inward, the threaded portions 34 of the two sidewall sections 24 are carried radially outward from the illustrated engagement configuration to disengage the threaded neck 2 of a container 4, permitting the cap 10 to be removed therefrom without rotation around the longitudinal axis by lifting the cap along the axis 12 away from the neck of the container. The sidewall sections are disallowed from flexing until the tamper-proof ring 14 is separated from the cap.

The threads 36 of the threaded portions 34 of the two sidewall sections 24 have tapered circumferential ends 38 (FIG. 8) to facilitate smooth use when the cap 10 is rotated and to facilitate disengagement when the tabs 50 are operated. The tabs 50, by spanning and thereby shrouding or overhanging the gaps 42, promote cleanliness from dust at the threaded neck of a container.

The cap 10 can be fabricated as a unitary item by, for example, injection molding. A resilient and durable material, such as plastic, can be used to facilitate multiple uses of the cap 10 on a host container. For example, once removed from a container by disengagement of the threads 36 by user force on the operable tabs 50, or the cap 10 can be returned to the container by rotation and threaded engagement to reseal the container multiple times. The internal threads taper in such a way that the cap may be forced onto the bottle neck by expanding the sidewalls as the cap is forced over the bottle neck threads.

In the above descriptions and in the drawing, threads protrude inwardly within the cap to engage threads that protrude outward from the bottle neck. Thus, threads are a particular type of male protrusions by which the cap engages the bottle neck. Other types of male protrusions can be used in other embodiments such that these descriptions and drawings relate as well to other such male protrusions. For example, rings or partial rings (non-helical) can be used as inward extending male protrusions in the cap to engage outward extending male protrusions on the bottle neck. Thus, although the illustrated embodiment has threads, simple male details can be used that can be snapped past and able to be cleared when the cap is squeezed. For example, a male standing rib similar to a thread but entirely horizontal.

After the tamper-proof ring has been broken, the cap may be replaced by snapping it on directly onto the bottle neck. As the male protrusions of the cap are pushed past the male protrusions of the bottle neck, the hollow protrusions allow the walls containing the male protrusions of the cap to flex outward as they ramp past the male protrusions of the bottle neck. The tamper-proof ring disallows this flexure by holding these walls in the original cylindrical form.

Another embodiment is illustrated in FIG. 9 through FIG. 17, in which an improved container assembly is provided and generally designated 110. The container assembly 110 includes a bottle 112 for including contents for edible consumption. In one or more embodiments, the bottle 112 may be a drink bottle, though any other consumable or even non consumables may be held within the bottle 112. The bottle 112 defines a bottle neck 114 extending from the container as is conventionally known. The bottle neck 114 is shown having a generally tapering cross-section, however, any appropriate configuration may be provided.

As illustrated, the bottle neck 114 defines a first circumferentially extending outwardly threaded portion 116, and a discontinuous second circumferentially extending outwardly threaded portion 120. The discontinuity between the first threaded portion 116 and the second threaded portion 120 is advantageous and will be described in greater detail further herein. Medial portions 122 between the first circumferentially extending outwardly threaded portion 116 and the second circumferentially extending outwardly threaded portion 120 is shown illustrated being free of threads. However, medial portion 122 may not be entirely free of threads, but instead have lesser radially extending threads.

A cap 124 is configured for being rotatably received on and engaged with the bottle neck 114. The cap 124 is illustrated in contact with the bottle neck 114. The cap 124 may be installed by pushing down onto the cap as will be described in more detail.

Figure 13:
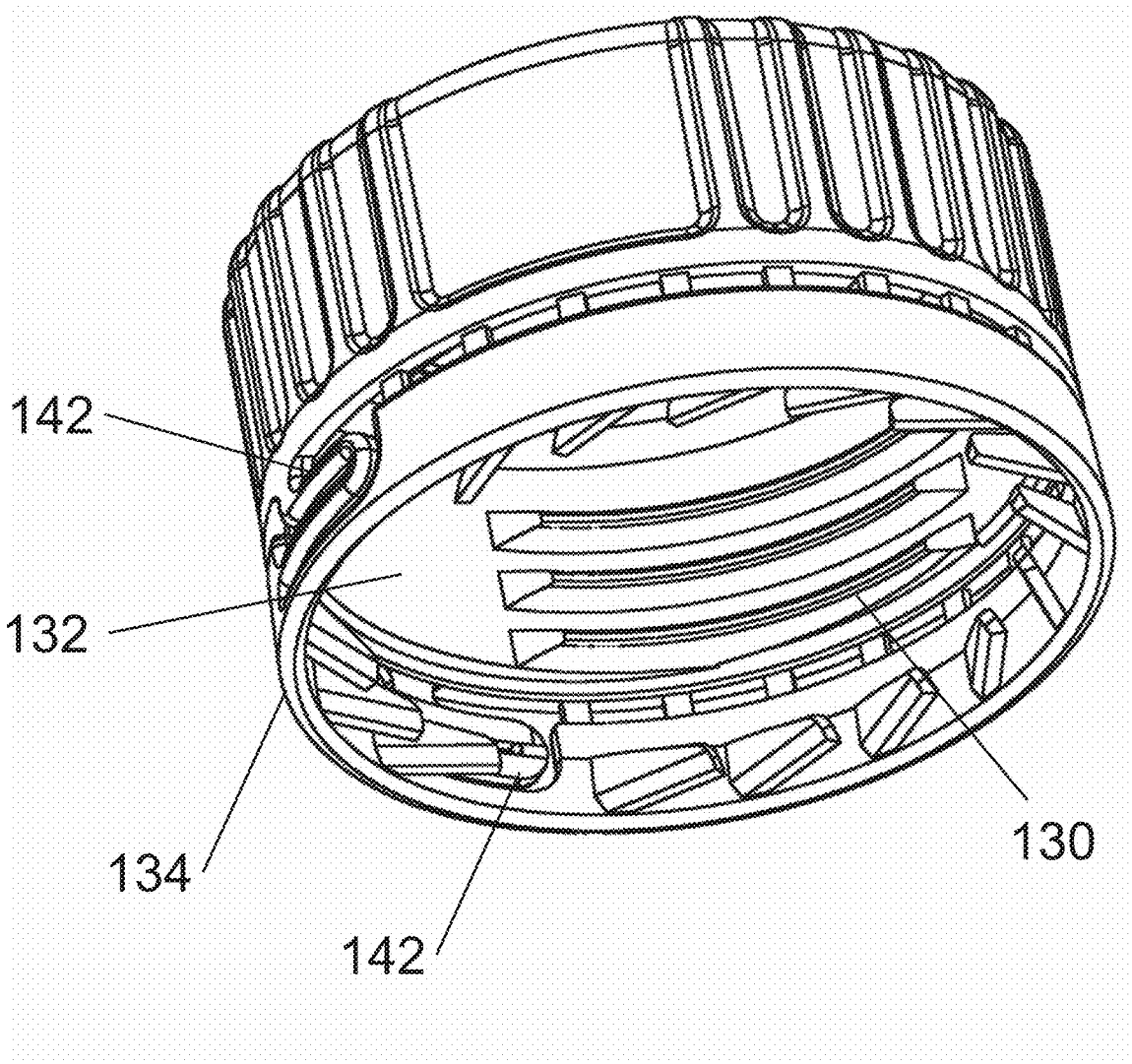
FIG. 13 is an upward facing, perspective view of the bottle cap according to one or more embodiments disclosed herein.
Figure 14:
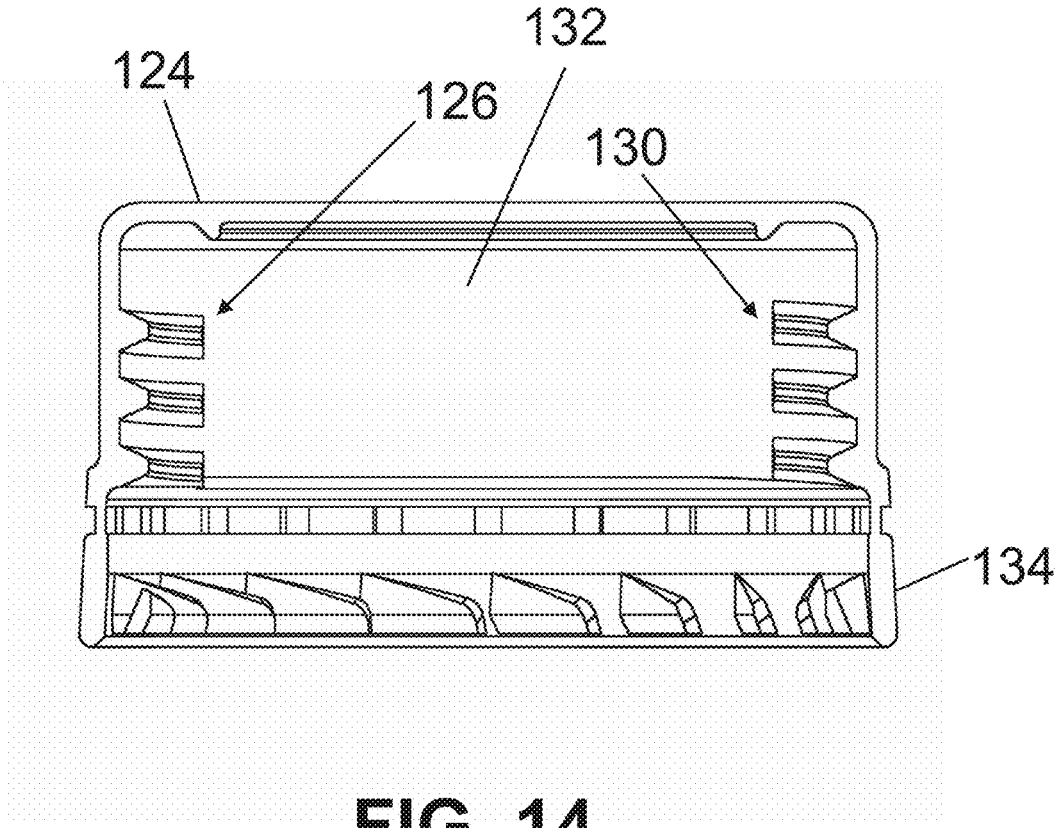
FIG. 14 is a cross-sectional view of the bottle cap of FIG. 13.

As illustrated well in FIGS. 13 and 14, the cap 124 defines a first circumferentially extending inwardly threaded portion 126, and a discontinuous second circumferentially extending inwardly threaded portion 130. A medial portion 132 between the first circumferentially extending inwardly threaded portion 126 and the second circumferentially inwardly extending threaded portion 130 is free of threads. The cap 124 is configured to engage and disengage the bottle neck 114.

Engagement occurs in a first engagement mode where an interference fit occurs between the outwardly extending threads 116, 120 of the bottle neck 114 and the inwardly extending threads 126, 130 of the cap 124. This first engagement mode is well illustrated in FIG. 11 and additionally in the cross-sectional view of FIGS. 14 and 15. This is similar to the conventional manner in which a bottle cap is engaged with a bottle neck.

Figure 12A:
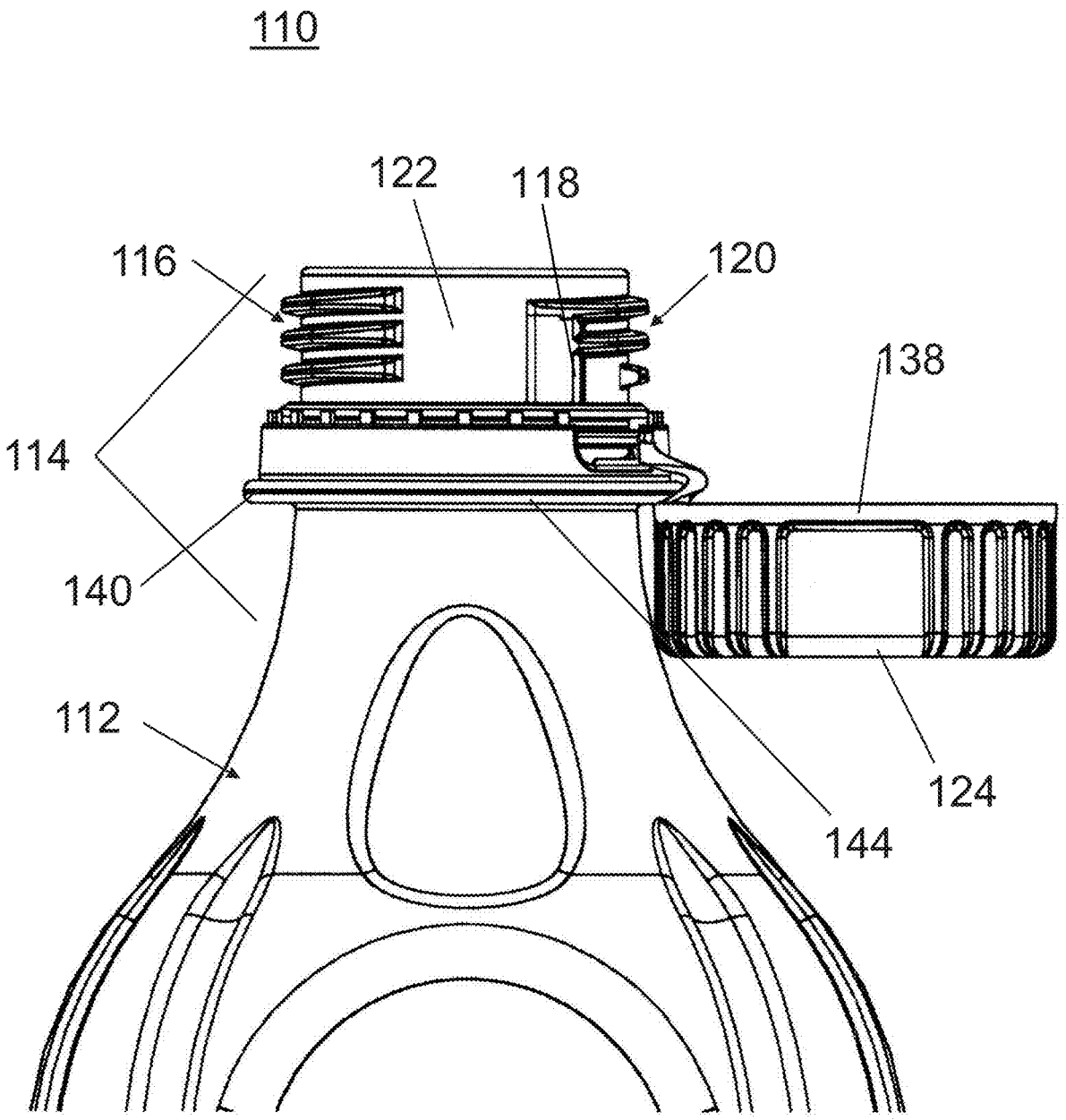
FIG. 12A is a side view of a bottle and associated improved cap according to one or more embodiments disclosed herein where the cap is shown not threadably engaged with the bottle neck, and the cap is shown in a stowed position.

Advantageously, disengagement occurs in a second engagement mode that is in response to general angular alignment of the medial portions 122 of the bottle neck 114 and the medial portions 132 of the cap 124 such that the threaded portions 116, 120 of the bottle neck 114 and the threaded portions 126, 130 of the cap 124 do not prohibitively restrict upward movement of the cap 124 in response to a user lifting the cap 124 off of the bottle 112. The user thus rotates the cap 124 until there is thread disengagement or the threads bump against a stop 118 (as indicated in FIG. 12A), and then pulls upwardly on the cap 124 to separate the cap 124 from the bottle. A tamper proof retaining ring 134 is received by the bottle neck 114. The tamper proof retaining ring 134 is similar in some aspects to tamper proof retaining rings known in the art. The tamper proof retaining ring 134 is initially coupled to a distal surface 138 of the cap 124, but is severed upon rotational movement of the cap 124 with rotational movement of the cap in a counter clockwise movement (relative to the drawings provided herein). Due to the angle of the threads 116, 120 on the bottle neck 114, rotation of the cap 124 thus imparts upwards movement of the cap 124 relative to the retaining ring 134, which causes the severing of the engagement between the retaining ring 134 and distal surface 138 of the cap 124, except for the remaining attachment of the couplers 142, which maintain attachment between the retaining ring 134 and the cap 124 (as described later herein). This severing may be aided by perforations or areas of weakened structure at the interface between the retaining ring 134 and distal surface 138 of the cap 124. Or otherwise any feature providing frangibility can be employed. The retaining ring 134 is engaged upwardly of a radially extending shoulder 140 from the bottle neck 114.

Advantageously, a coupler 142 extends between the retaining ring 134 and the cap 124. The coupler 142 is well illustrated throughout the Figures, but in particular with reference to FIGS. 9 and 10. The coupler 142 is illustrated as a two spaced-apart arm assembly extending from the retaining ring 134 to the cap 124, however, any appropriate configuration may be employed. The advantageous aspect is that the coupler 142 provides for hinged movement of the cap 124 relative to the bottle neck 114. This may be accomplished by providing sufficiently flexible material and construction to the coupler 142.

Figure 11:
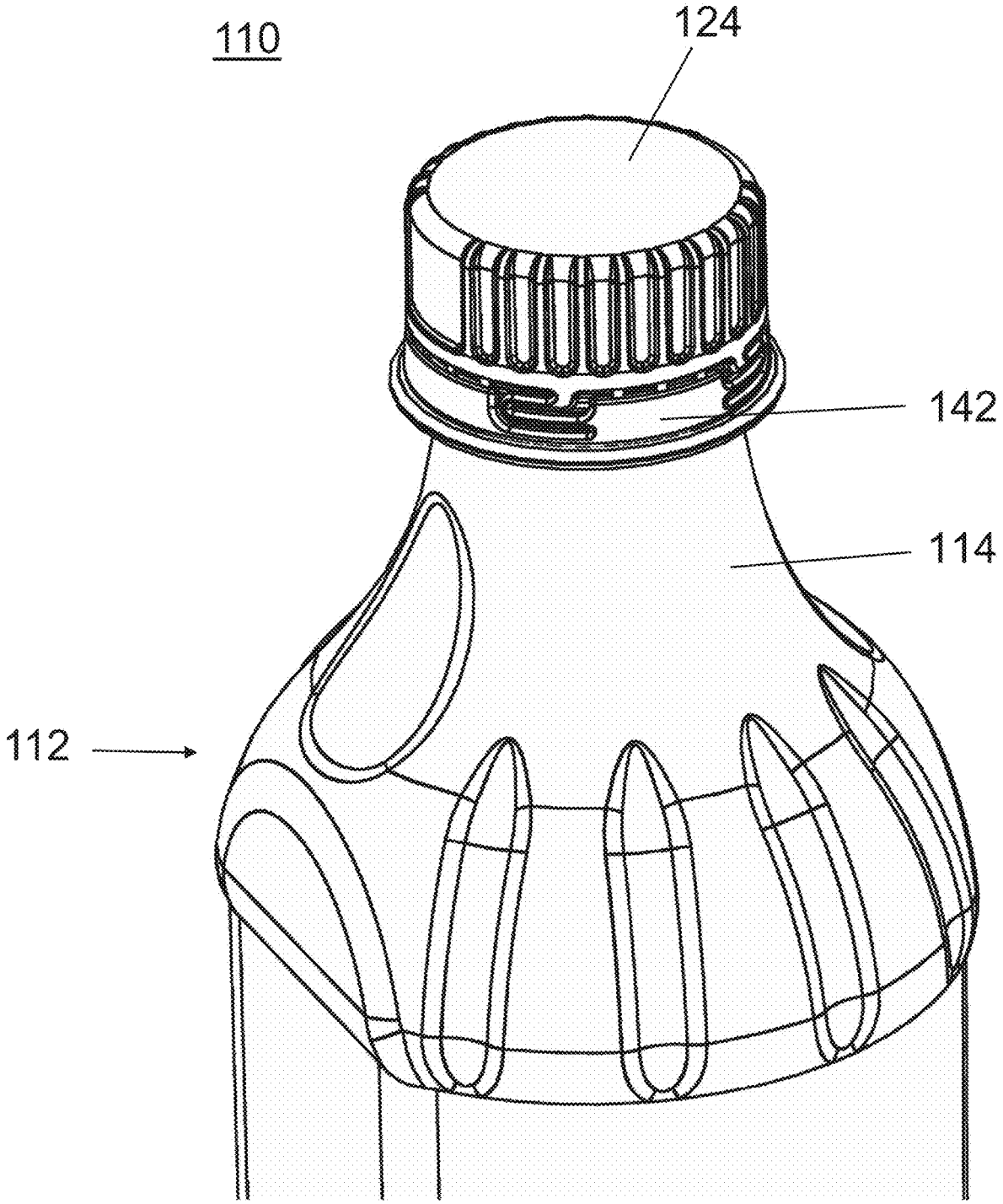
FIG. 11 is a perspective view of a bottle and associated improved cap according to one or more embodiments disclosed herein where the cap is shown threadably engaged with the bottle neck.
Figure 12B:
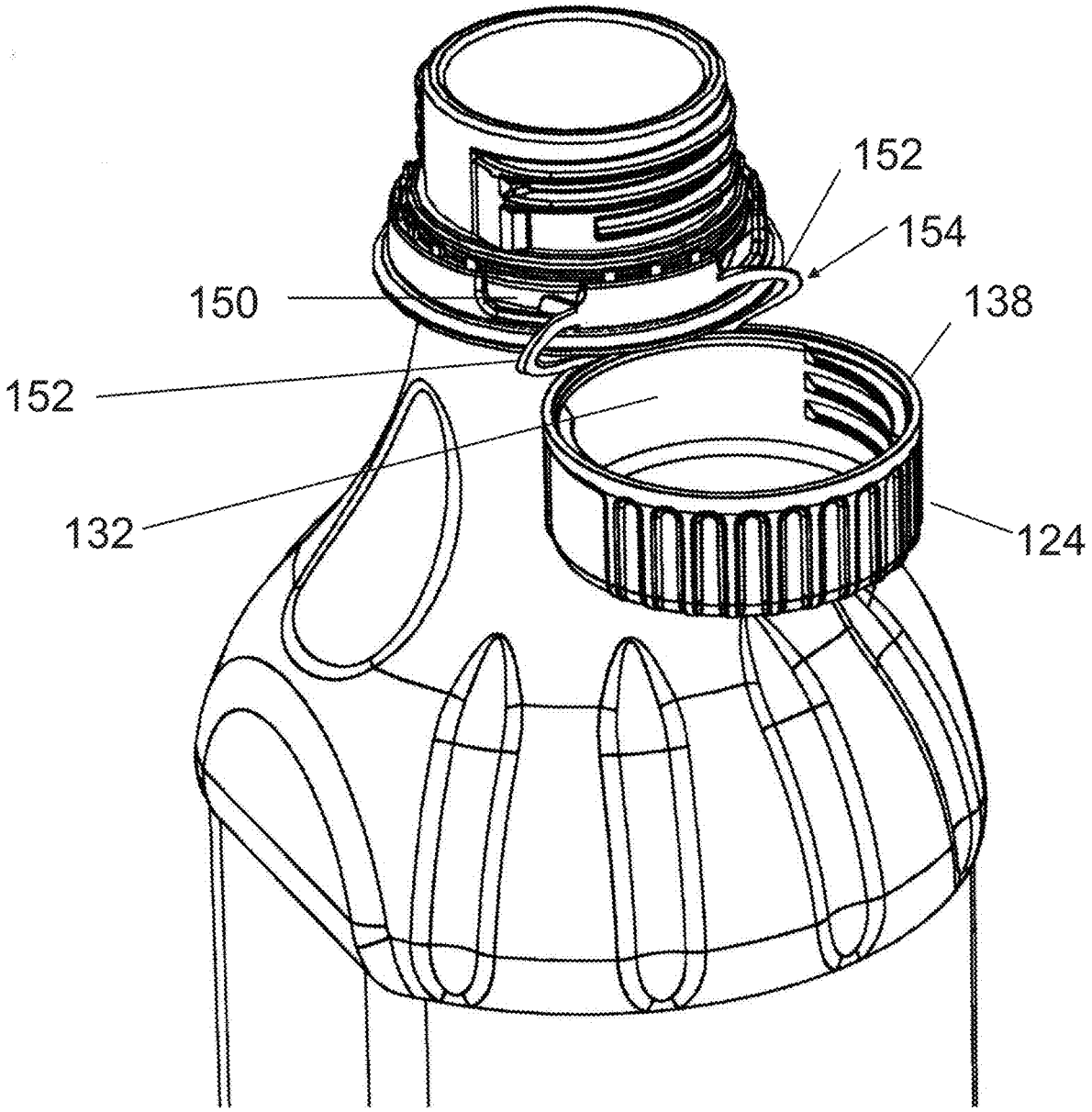
FIG. 12B is a perspective view of a bottle and associated improved cap according to one or more embodiments disclosed herein where the cap is shown not threadably engaged with the bottle neck, and the cap is shown in a stowed position.

The coupler 142 provides for at least two main advantages. The coupler 142 allows for inversing movement of the cap 124 from an engaged position as illustrated in FIG. 11 to a stowed position as illustrated in FIGS. 12A and 12B in which the cap 124 is hingedly pivoted away from the bottle neck 114 and the distal surface 138 of the cap 124 is engaged with a bottom surface 144 of the radially extending shoulder 140. Thus, in the position and orientation, providing distance from the inverted cap and the distal edge of the bottle neck, illustrated in FIGS. 12A and 12B, the cap 124 is shown stowed so that the cap does not impede the ability of a user to tip the bottle 112 upwardly and consume or pour out the contents. Additionally, the cap 124 is always maintained in contact with the bottle 112 so that the cap 124 does not move into a position to the bottle 112 such that it impedes a user from accessing the bottle 112 for drinking or positioning the cap such that it impedes pouring. This advantageously provides for improved compliance with recycling since the cap 124 and bottle 112 will be recycled together. Additionally, it reduces littering associated with the much smaller cap 124 since the cap 124 and bottle 112 are always coupled together.

As illustrated with reference to FIG. 11 where the cap is shown engaged to the bottle neck and more particularly FIG. 12B, FIG. 11 shows a unique advantage of the coupler 142, having arms 152 and a pivot point 154, which attaches to the distal portion of the cap 124, traverses radially in an outward direction then turns downward to traverse in the opposite radial direction. When the cap 124 is in its placed in the inverted position, this coupler configuration provides a controlled gap for the bottle shoulder 140 to occupy, thereby capturing the cap in this position by having segments of the coupler 142, such as portions of the arms 152, above and below the bottle shoulder 140, as illustrated in FIG. 12B.

Figure 9:
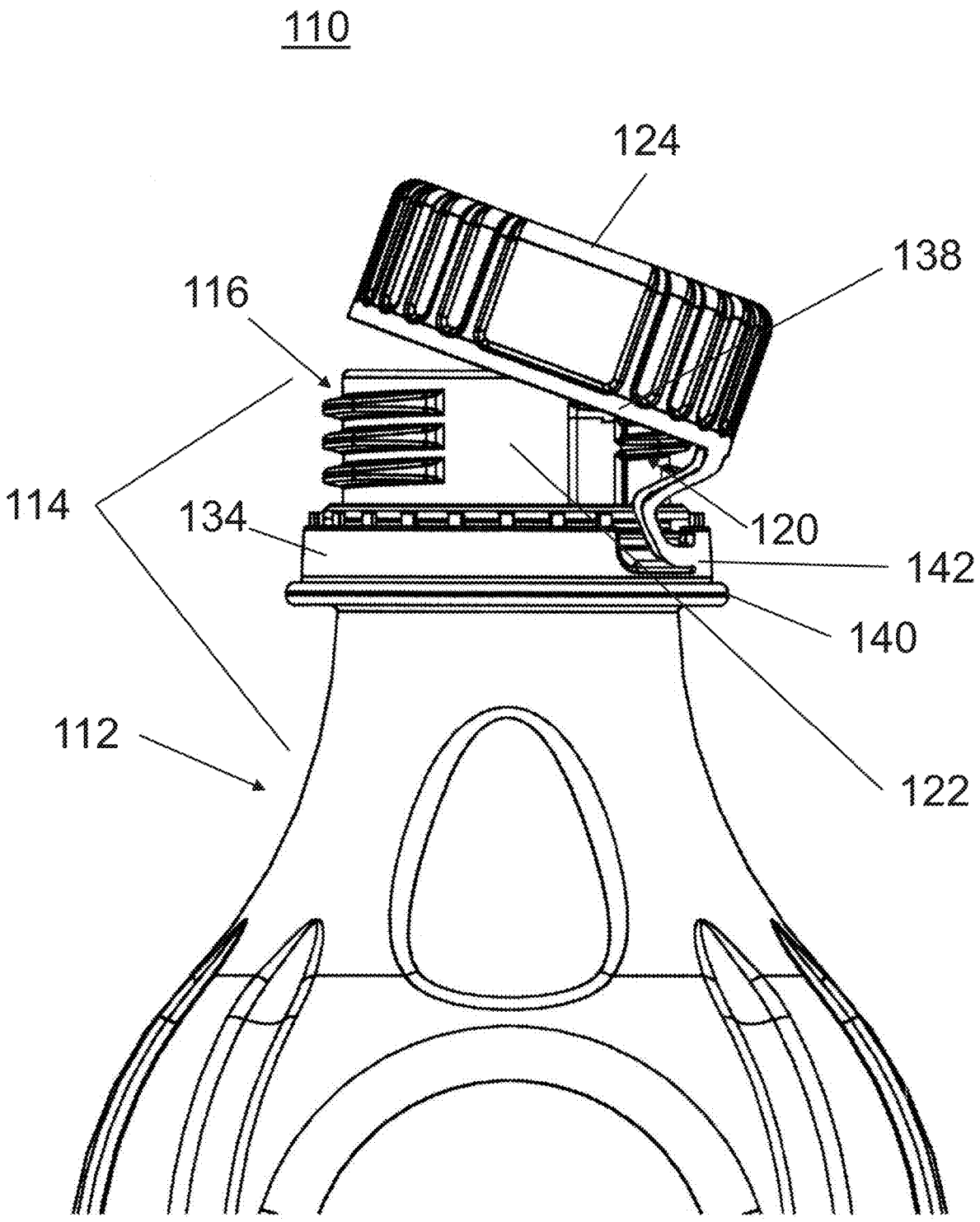
FIG. 9 is a side view of a bottle and associated improved cap according to one or more embodiments disclosed herein.
Figure 10:
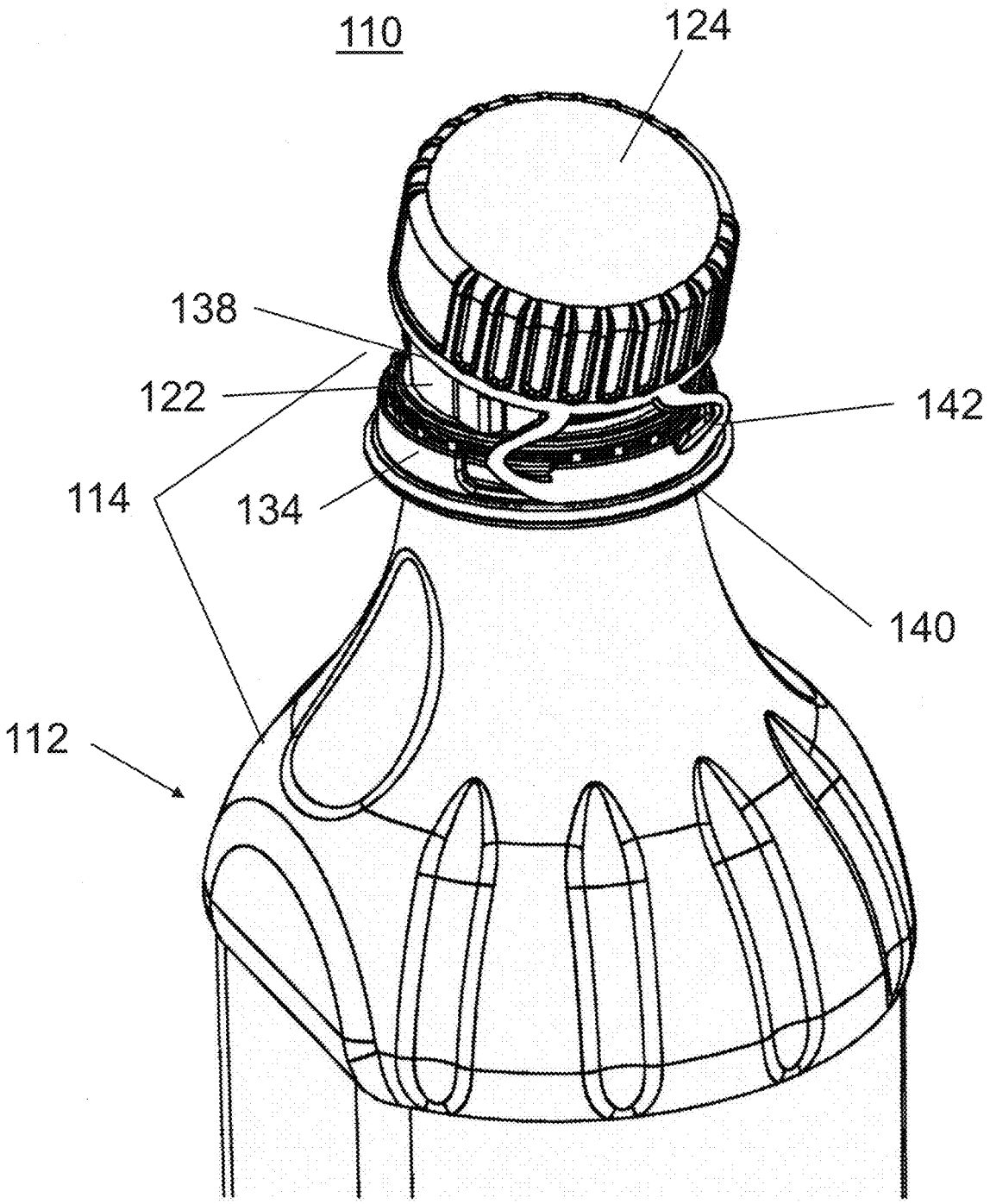
FIG. 10 is a perspective view of a bottle and associated improved cap according to one or more embodiments disclosed herein where the cap is shown not threadably engaged with the bottle neck.

The user can then return the cap 124 to its proper position by inverting of the cap 124 back into a position generally illustrated in FIG. 9 and pushing downwardly onto the cap after aligning medial portions 122 and 132 in a manner that is generally the opposite of removal. Once the cap 124 has been pushed downwardly until the bottom surface 138 is proximal the retaining ring 134 at which time the interior, bottom distal surface of the top of cap 124 is bottoming out on the sealing edge of the bottle neck 114, the cap 124 is rotated clockwise to secure the cap 124 to the bottle neck 114 by engagement of threads 116, 120 and threads 126, 130.

Figure 16:
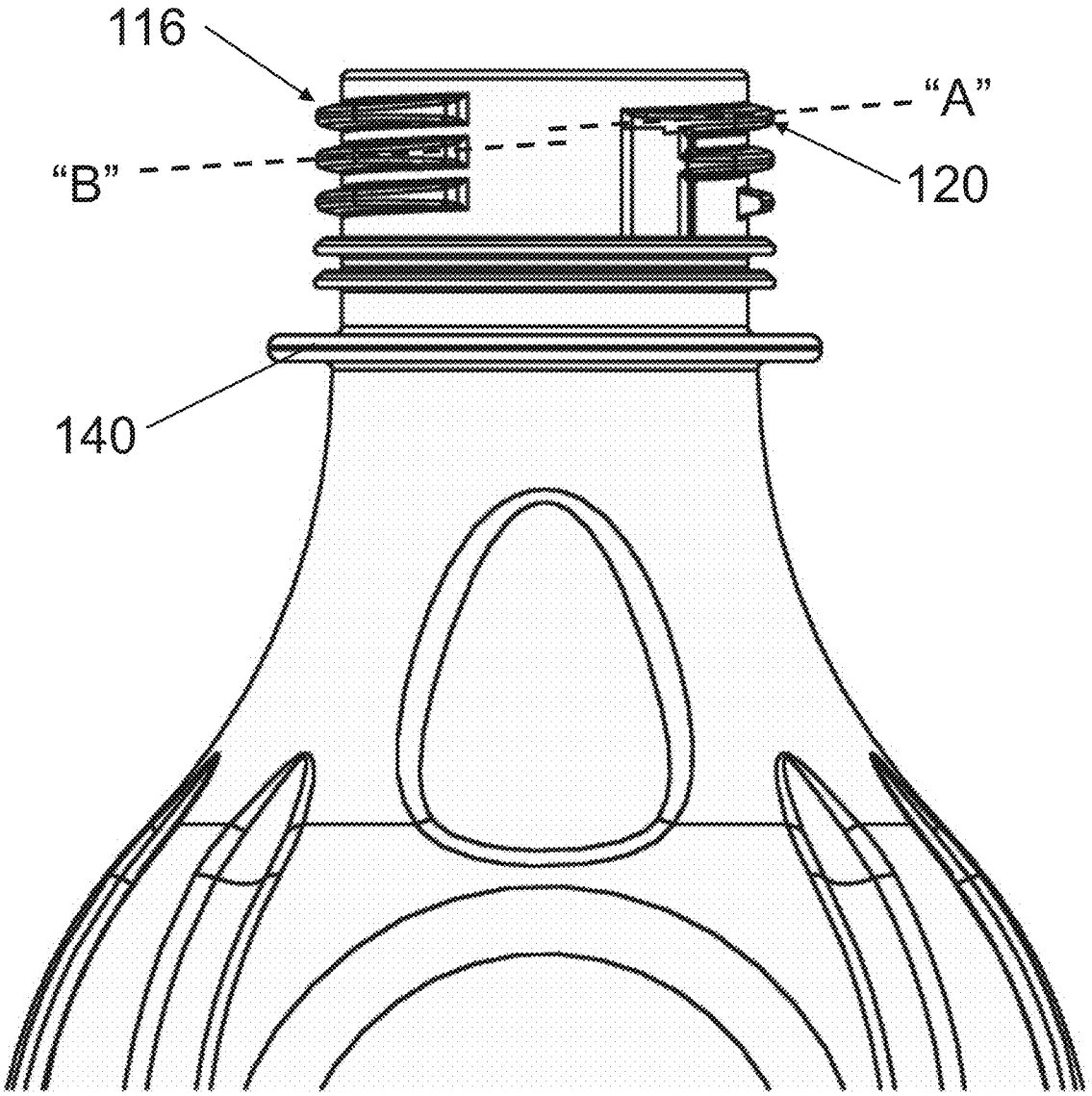
FIG. 16 is an additional side view of the bottle according to one or more embodiments disclosed herein.

Due to the fact that the threads 116, 120 of the bottle neck 114 are discontinuous and full circle rotations of the cap 124 are not required to disengage or engage the cap 124 with the bottle neck 114, the threads 116 and threads 120 do not lie within a same plane as is typical in the art. For example, as illustrated in FIG. 16, threads 116 may be positioned on a plane "A" and threads 120 on a plane "B," and the planes are parallel but also spaced-apart. This advantageously increases overall structural integrity of the thread pattern. Additionally, the threads 116 and threads 120 can thus be inverse, such that it is the exact thread detail rotated one hundred and eighty degrees axially.

Figure 17:
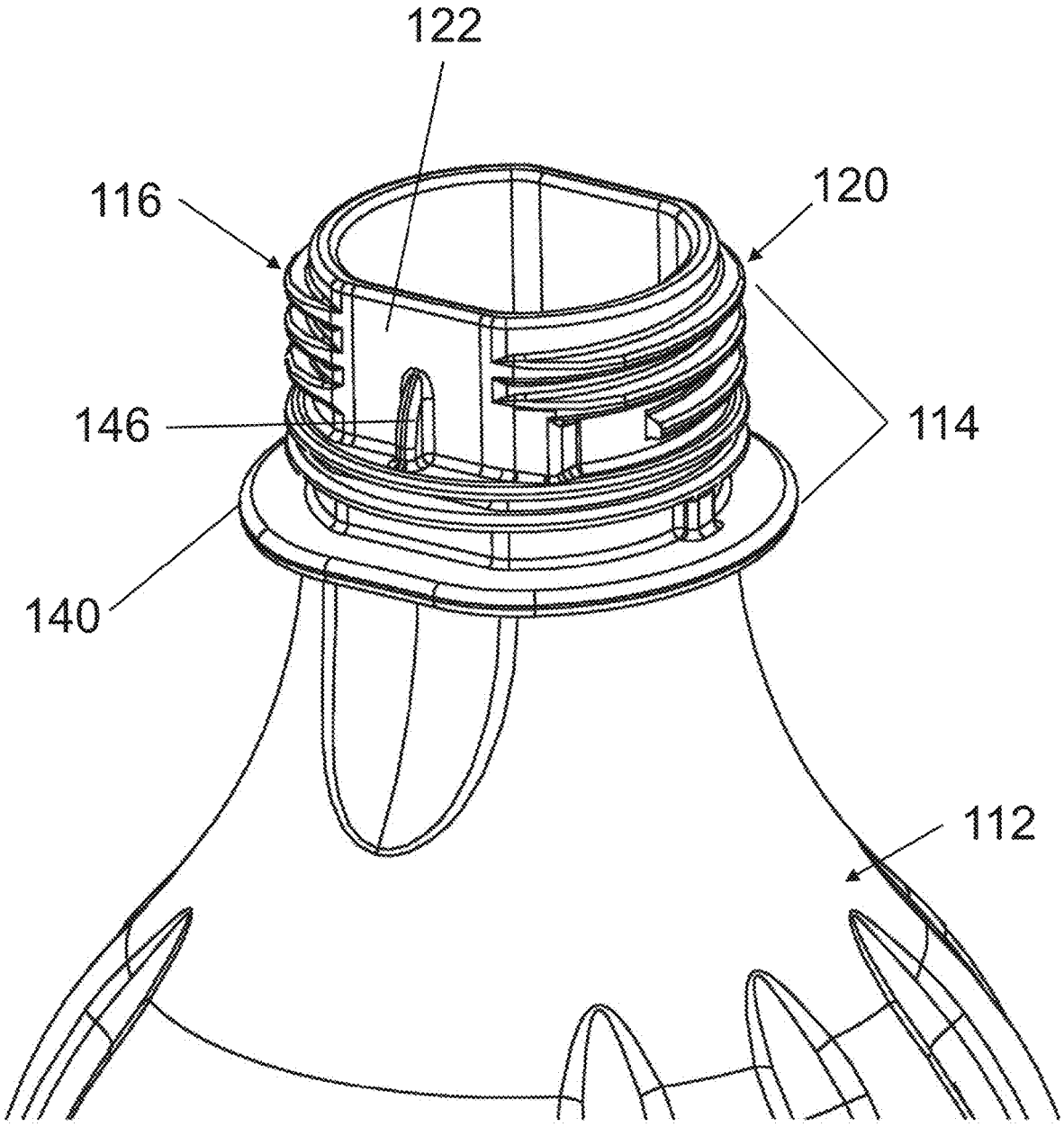
FIG. 17 is an additional perspective view of the bottle according to one or more embodiments disclosed herein.

As illustrated in FIG. 17, a flat surface is positioned in the medial portion 122, such that there is no engagement of the cap 124 and bottle neck 114 in a rotation position where the inward facing threads 126, 130 of the cap 124 are aligned with the flat medial portion 122 of the bottle neck 114. A detent 146 may extend from a surface of the medial portion 122 of the bottle neck 114. The detent 146 is to maintain the overall cylindrical form such that the cap 124 does not elongate and disengage from the threaded portions 116 and 120 of the bottle neck 114.

Figure 15:
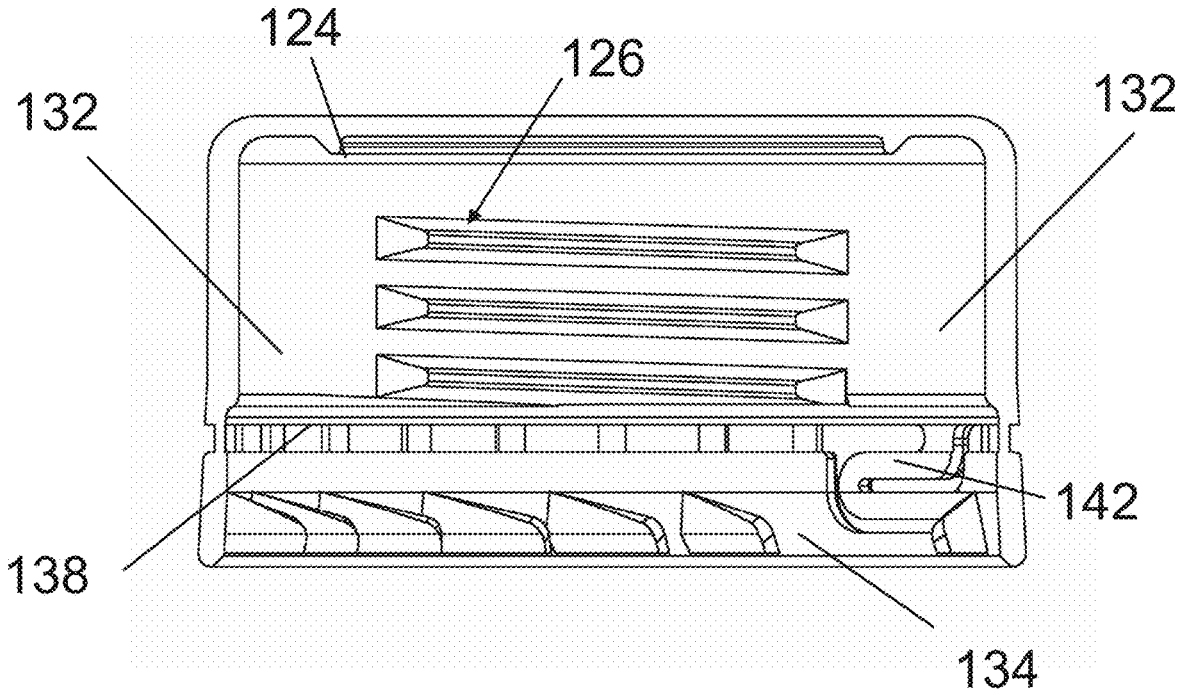
FIG. 15 is a cross-sectional view of the bottle cap of FIG. 14 shown rotated by ninety degrees.

As illustrated well within FIG. 15, the tamper proof retaining ring 134 may define a void 150 in which a portion of the coupler 142 is received in. The coupler 142 is configured to elongate upwardly in response to the user pulling upwardly on the cap. This is well illustrated in FIG. 9 in which the coupler 142 is elongated upwardly. The coupler 142 may include a pair of arms 152 as illustrated in FIG. 12B. The pair of arms 152 are configured for to bend at a pivot point 154 where the pivot point 154 is adjacent the shoulder 140 of the bottle neck 114 when the cap 124 is inversed into the stowed position.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A container assembly comprising:

a bottle for including contents, the bottle including a bottle neck extending from the bottle, the bottle neck including a first threaded neck portion circumferentially extending outwardly, and a discontinuous second threaded neck portion circumferentially extending outwardly, wherein both the first threaded neck portion and the second threaded neck portion have a first circumferential arc length, wherein medial portions are disposed between the first threaded neck portion and the second threaded neck portion, are free of threads, and have a second circumferential arc length, wherein the bottle further defines a radially extending shoulder that extends from the bottle neck;

a cap configured for being rotatably received on and engaged with the bottle neck, the cap defining a first threaded cap portion circumferentially extending inwardly, and a discontinuous second threaded cap portion circumferentially extending inwardly wherein both the first threaded cap portion and second threaded cap portion have a third circumferential arc length, wherein medial portions are disposed between the first threaded cap portion and the second threaded cap portion, are free of threads, and have a fourth circumferential arc length, wherein the fourth circumferential arc length is greater than the first circumferential arc length and the second circumferential arc length is greater than the third circumferential arc length, wherein the cap is configured to engage and disengage the bottle neck, where engagement occurs in a first engagement mode where an interference fit occurs between the first and second threaded neck portions and the first and second threaded cap portions, and where engagement occurs in a second engagement mode that is in response to general angular alignment of the medial portions of the bottle neck and the medial portions of the cap such that the first and second threaded neck portions and the first and second threaded cap portions do not restrict upward movement of the cap in response to a user lifting the cap off of the bottle and wherein the first and second threaded neck portions are disposed in concentric radial alignment with the medial portions of the cap and the first and second threaded cap portions are disposed in concentric radial alignment with medial portions of the bottle neck;

a tamper proof retaining ring that is received by the bottle neck, the tamper proof retaining ring being configured for rotational movement about the bottle neck and engaging a distal surface of the cap, the tamper proof retaining ring being positioned above the radially extending shoulder of the bottle neck; and a coupler extending between the tamper proof retaining ring and the cap, the coupler allowing for inversing movement of the cap from an engaged position to a stowed position in which the cap is hingedly pivoted away from the bottle neck and the distal surface of the cap is engaged with a bottom surface of the radially extending shoulder and a first plane passing through the distal surface of the cap in the stowed position is on an opposite side of a second plane containing the shoulder from a third plane containing the tamper proof ring, wherein the first plane second plane and third plane are all parallel to each other.

2. The container assembly of claim 1, further comprising a detent extending from a surface the medial portions of the bottle neck, wherein the detent is configured to maintain a cylindrical form of the cap such that it is not allowed to elongate such that it lessens thread engagement.

3. The container assembly of claim 1, wherein the first threaded neck portion and the second threaded neck portion of the bottle neck each define a thread direction where the thread direction of the first threaded neck portion is parallel with but not in direct helical alignment with the thread direction of the second threaded neck portion.

4. The container assembly of claim 1, wherein the tamper proof retaining ring defines a void in which a portion of the coupler is received in.

5. The container assembly of claim 4, wherein the coupler is configured to elongate upwardly from a first position where the distal surface of the cap contacts the tamper proof retaining ring to a second position wherein the cap is separated from the neck of the bottle in response to the user pulling upwardly on the cap without a full circle rotation of the cap.

6. The container assembly of claim 4, wherein the coupler comprises a pair of arms, wherein the pair of arms are configured to bend at a pivot point, the pivot point being adjacent the radially extending shoulder of the bottle neck when the cap is inversed into the stowed position.

7. The container assembly of claim 6, wherein the pair of arms are attached to the tamper proof retaining ring in an opposing direction within a first horizontal plane, such that during extension, together with the cap, the pair of arms form a void shaped as to receive the radially extending shoulder of the bottle without interference when the cap is in the stowed position.

8. The container assembly of claim 7, wherein the pair of arms are configured such that, when the cap is in the stowed position a first portion of each arm of the pair of arms is disposed in a second horizontal plane above the radially extending shoulder and a second portion of each arm of the pair of arms is disposed in a third horizontal plane below the bottle shoulder, thereby capturing the radially extending shoulder and retaining the cap in the stowed position.

9. The container assembly of claim 1, further comprising a stop at a lower side of each set of first threaded neck portion and the second threaded neck portion that disallows further rotation of the cap to indicate to the user to initiate lifting action to complete removal of the cap.

10. A cap configured for use with a bottle neck extending from a bottle, wherein the bottle neck includes a first threaded neck portion circumferentially extending outwardly, and a discontinuous second threaded neck portion circumferentially extending outwardly, wherein both the first threaded neck portion and the second threaded neck portion have a first circumferential arc length, wherein medial portions between the first threaded neck portion and the second threaded neck portion are free of threads, and have a second circumferential arc length, and a radially extending shoulder from the bottle neck, the cap comprising:

a first threaded cap portion, and a discontinuous second threaded cap portion both having a third circumferential arc length, wherein medial portions are disposed between the first threaded cap portion and the second threaded cap portion and are free of threads, and have a fourth circumferential arc length, wherein the fourth circumferential arc length is greater than the first circumferential arc length and the second circumferential arc length is greater than the third circumferential arc length, and wherein the cap is configured to engage and disengage the bottle neck, where engagement occurs in a first engagement mode where an interference fit occurs between the outwardly extending threads of the bottle neck and the inwardly extending threads of the cap, and where engagement occurs in a second engagement mode that is in response to general angular alignment of the medial portions of the bottle neck and the medial portions of the cap such that the threaded portions of the bottle neck and the threaded portions of the cap do not restrict upward movement of the cap in response to a user lifting the cap off of the bottle;

a tamper proof retaining ring that is configured to be received by the bottle neck and disposed above the radially extending shoulder, the tamper proof retaining ring being configured for rotational movement about the bottle neck and engaging a distal surface of the cap; and a coupler extending between the tamper proof retaining ring and the cap, the coupler configured to allow inversing movement of the cap from an engaged position to a stowed position in which the cap is hingedly pivoted away from the bottle neck and the distal surface of the cap is engaged with a bottom surface of the radially extending shoulder.

11. The cap of claim 10, wherein the tamper proof retaining ring defines a void in which a portion of the coupler is received in.

12. The cap of claim 11, wherein the coupler is configured to elongate upwardly from a first position where the distal surface of the cap contacts the tamper proof retaining ring to a second position wherein the cap is separated from the neck of the bottle in response to the user pulling upwardly on the cap without a full circle rotation of the cap.

13. The cap of claim 11, wherein the coupler comprises a pair of arms, wherein the pair of arms are configured to bend at a pivot point, the pivot point being adjacent the radially extending shoulder of the bottle neck when the cap is inversed into the stowed position.

14. The cap of claim 13, wherein the pair of arms are attached to the tamper proof retaining ring in an opposing direction within a first horizontal plane, such that during extension, together with the cap, the pair of arms form a void shaped as to receive the radially extending shoulder of the bottle without interference when the cap is in the stowed position.

15. The cap of claim 14, wherein the pair of arms are configured such that, when the cap is in the stowed position a first portion of each arm of the pair of arms is disposed in a second horizontal plane above the bottle shoulder and a second portion of each arm of the pair of arms is disposed in a third horizontal plane below the radially extending shoulder, thereby capturing the radially extending shoulder and retaining the cap in the stowed position.

* * * * *